US006183109B1

(12) United States Patent
Nelson et al.

(10) Patent No.: US 6,183,109 B1
(45) Date of Patent: Feb. 6, 2001

(54) ILLUMINATED MOLDINGS AND METHOD FOR ILLUMINATING THEREWITH

(75) Inventors: Thomas John Nelson, Belton; Peter Charles Gaa, Temple; Yein Ming Lee, Temple; Bruce Rodney Trethewey, Jr., Temple, all of TX (US)

(73) Assignee: Premark RWP Holdings, Inc., Wilmington, DE (US)

( * ) Notice: Under 35 U.S.C. 154(b), the term of this patent shall be extended for 0 days.

(21) Appl. No.: 09/193,911

(22) Filed: Nov. 17, 1998

(51) Int. Cl.[7] ..... F21V 21/00

(52) U.S. Cl. ..... 362/249; 362/33; 362/252; 362/800; 40/421; 40/616

(58) Field of Search ..... 362/249, 251, 362/252, 800, 84, 184, 127, 133, 33, 97, 151, 152; 40/219, 421, 616; 340/907

(56) References Cited

U.S. PATENT DOCUMENTS

| | | | | |
|---|---|---|---|---|
| 2,709,766 | * | 5/1955 | Nagy et al. | 313/486 |
| 2,762,165 | * | 9/1956 | Fulkerson et al. | 240/2.25 |
| 3,500,036 | * | 3/1970 | Szentvern | 362/249 |
| 3,869,637 | * | 3/1975 | Usui | 313/512 |
| 4,990,804 | | 2/1991 | McNair | 250/493.1 |
| 5,536,078 | * | 7/1996 | Novikoff | 312/195 |
| 5,577,831 | * | 11/1996 | Chang | 362/240 |
| 5,823,655 | * | 10/1998 | Brooks | 362/145 |
| 5,980,071 | * | 6/1998 | Hsieh | 362/249 |

FOREIGN PATENT DOCUMENTS

| | | | |
|---|---|---|---|
| 8631115 | 11/1989 | (DE) . | |
| 448361 | 1/1913 | (FR) . | |
| 2272279 | 5/1994 | (GB) | F21V/33/00 |

* cited by examiner

*Primary Examiner*—Sandra O'Shea
*Assistant Examiner*—Bertrand Zeade
(74) *Attorney, Agent, or Firm*—Aquilino, Welsh & Flaxman

(57) ABSTRACT

Disclosed is a molding with a built-in illumination member. The illumination member may be an ordinary light or series of lights, or a repeating message board made of light emitting diodes, or a compound that glows under ultraviolet light, or a compound that glows in the dark, or the like. The molding may be the front edge molding on a worktop.

20 Claims, 6 Drawing Sheets

ILLUMINATED MOLDINGS AND METHOD FOR ILLUMINATING THEREWITH

TECHNICAL FIELD

The present invention relates to decorative moldings such as those used as front edges on worktops. The present invention has further relation to removable moldings provided with integral illumination.

BACKGROUND OF THE INVENTION

Moldings are typically made of wood, plastic, metal or the like, and are decorative in nature. Moldings are usually made of one type of material, but specialty moldings exist that are made up of a combination of materials, such as wood and metal for example. Various types of moldings and their construction are well known to those skilled in the art.

Lighting is typically installed in the home, office, etc. in a way that is completely unrelated to moldings used in the same areas. Lighting usually hangs from the ceiling, is mounted to the walls, or sits on desk and tabletops. Nightlights are employed in a similar fashion, or are plugged into electrical outlets in the walls. In offices or businesses, repeating message boards, such as those that report stock market figures, are usually hung on the walls.

There exists a need then for a molding that incorporates illumination as part of the molding, and a molding with an integral illumination member. There also exists a need for an illuminated molding that may serve as a nightlight, mood lighting, or the like. There exists a need for an illuminated worktop front edge molding to serve such purposes. There also exists a need for an easy way to install such molding that is within the realm of the skill of the average consumer. The objects of the present invention are to fill these unmet needs, and these and other objects of the invention will become apparent through the specification, claims, and drawings provided herein.

SUMMARY OF THE INVENTION

Disclosed is a molding with a built-in illumination member. The illumination member may be an ordinary light or series of lights, or a repeating message board made of light emitting diodes, or a compound that glows under ultraviolet light, or a compound that glows in the dark, or the like. If required, the illuminating member may be energized by an alternating current power source, or by a direct current power source. The illuminating member may also include an on/off switch. The molding may be worktop front edge molding that is removably attached to a worktop.

Also disclosed is a method of illuminating a front edge of a worktop comprising the steps of providing a front edge molding having a built-in illumination member, removably attaching the front edge molding to the worktop, and coupling the illumination member to a power source. The method may also include the step of coupling an on/off switch between the power source and the illumination member.

DETAILED DESCRIPTION OF THE PREFERRED EMBODIMENT

A detailed embodiment of the present invention is now disclosed. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
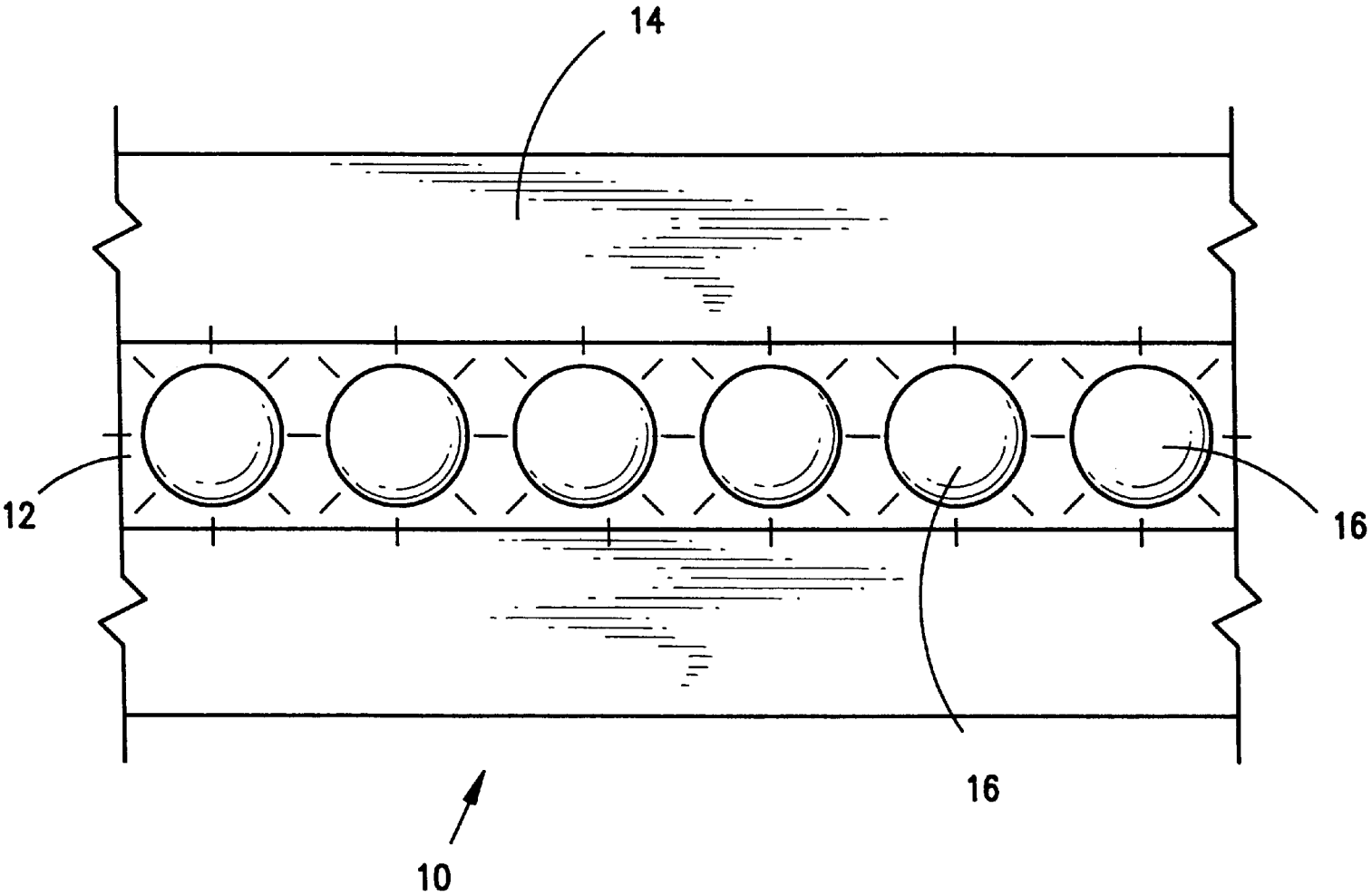
FIG. 1 is an exploded elevational front view of an embodiment of illuminated molding in accordance with the present invention.

FIG. 1 shows a front view of an illuminated molding 10 in accordance with the present invention. As will be described in greater detail below, the illuminating member 12 is centrally inserted into the body 14 of molding 10. Illuminating member 12 may include a series of lights 16, which may be incandescent lights, light emitting diodes, or the like. The illuminating member 12 may be a repeating message board to provide not only light, but also information, to people who view the molding. Illuminating member 12 may also be a compound that glows under ultraviolet light, or a compound that glows in the dark, or the like. If required, the illuminating member 12 may be energized by an alternating current power source, or by a direct current power source. The illuminating member 12 may also include an on/off switch (not shown) coupled between the power source and the illuminating member 12, and installed at some point in the surface of molding 10 for easy access by a user.

Figure 2A:
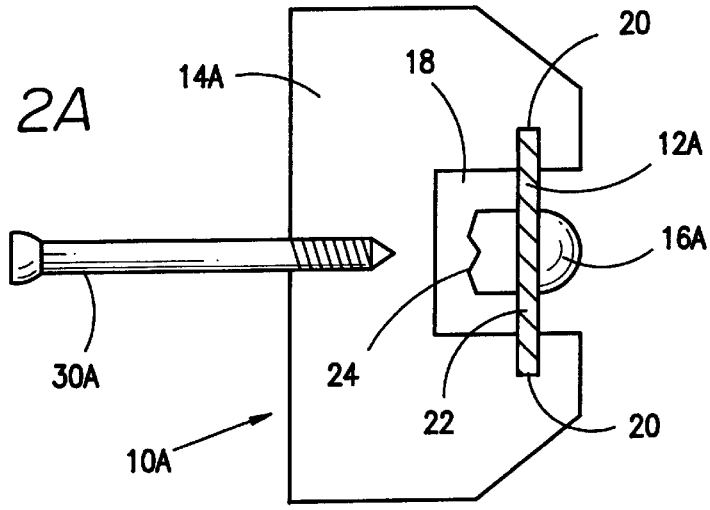
FIG. 2A is an elevational sectional view of an embodiment of illuminated molding in accordance with the present invention.
Figure 2B:
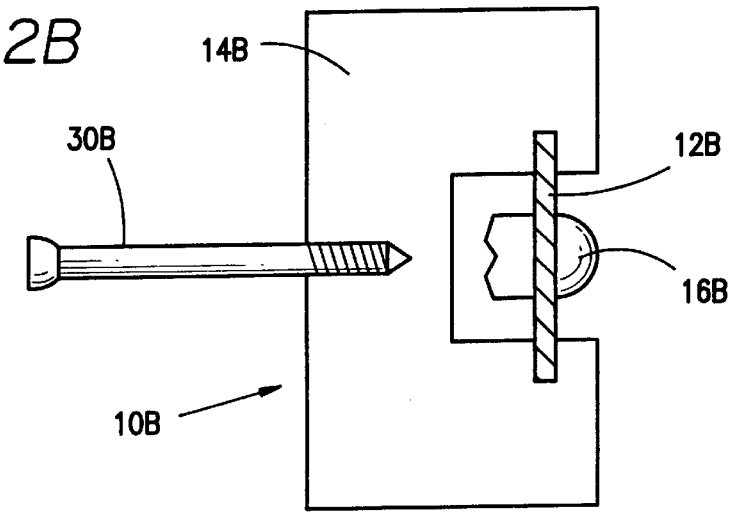
FIG. 2B is an elevational sectional view of another embodiment of illuminated molding in accordance with the present invention.
Figure 2C:
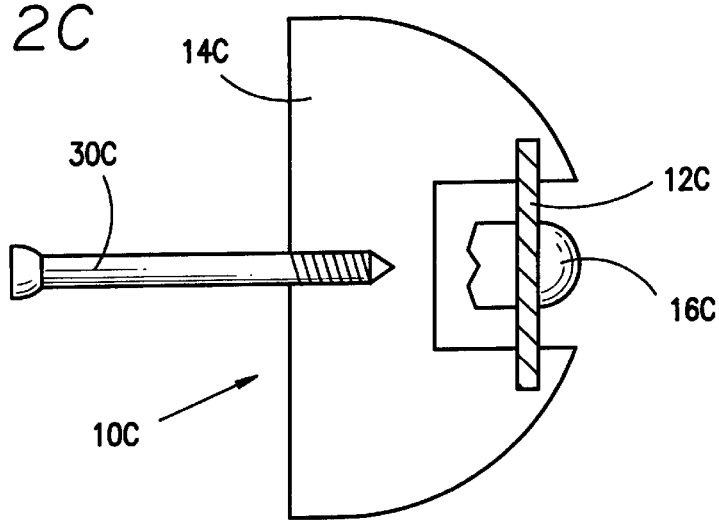
FIG. 2C is an elevational sectional view of yet another embodiment of illuminated molding in accordance with the present invention.

FIGS. 2A, 2B, and 2C show various embodiments of the present invention simply to show that various molding shapes may be employed. The present discussion will revolve around the embodiment shown in FIG. 2A. Body 14A includes hollowed-out area 18. Grooves 20 are cut into body 14A by traditional methods known in the art. Illuminating member plate 22 is sized to slide comfortably into grooves 20. Lights 16A may be attached at fixed intervals to plate 22, for example as shown in FIG. 1. Couplings 24 provide electrical contact among lights 16A within a member 10A and terminate is a connection to a power source (not shown). Alternatively, a glow in the dark or glow under ultraviolet light compound may be coated onto the front surface of plate 22 so as to provide illumination with no need for a power source. Additionally, plate 22 may be a translucent, decorative front cover strip which houses and encloses a light source mounted in area 18 behind plate 22.

Figure 3:
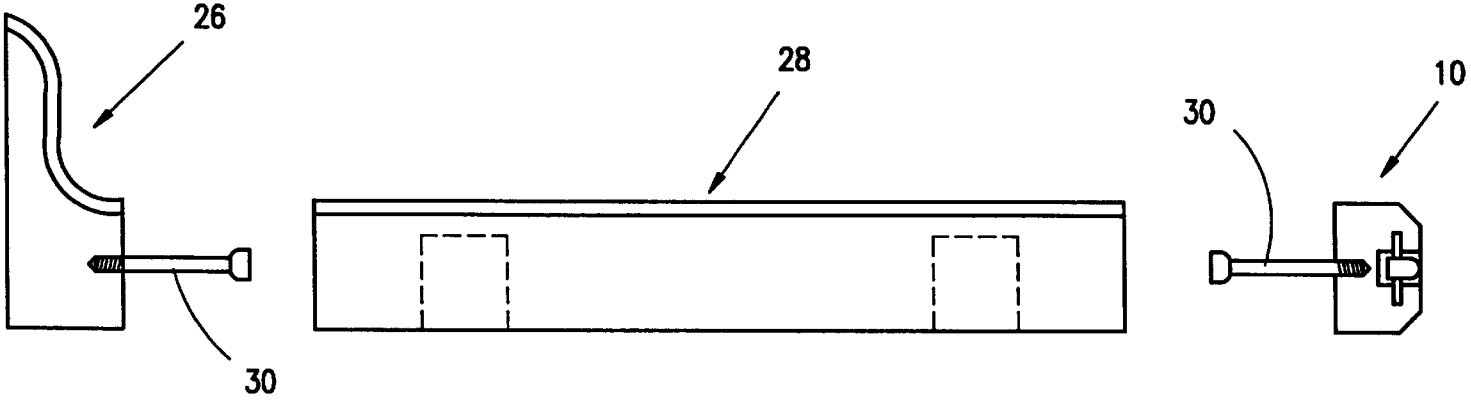
FIG. 3 is an elevational side view of worktop component parts, including the molding of the present invention.
Figure 4:
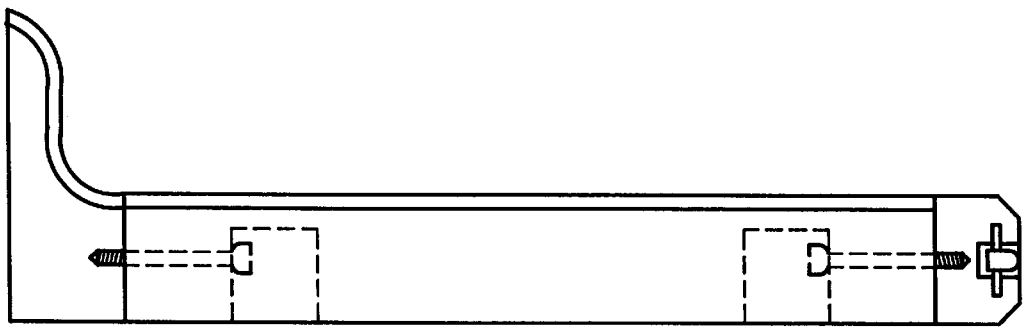
FIG. 4 is an elevational side view of an embodiment of an assembled worktop and front edge molding in accordance with the present invention.

FIG. 3 shows the typical component parts of a worktop associated with the present invention. FIG. 3 shows a backsplash 26, a surface member 28, and a front edge molding 10 in accordance with the present invention. These components are constructed of typical decorative surfacing materials known in the art, such as high pressure decorative laminate, solid surfacing, solid surfacing veneer, natural and artificial stone compositions, and the like. These materials may or may not require use of a substrate in conjunction with the decorative layer; such substrates known to the art are fiberboard, particleboard, foamed polymers, wood, and the like.

Each of components 11, 26, and 28 may be supplied in a variety of different colors, materials, surface textures, etc., backsplash 26 and front edge 10 may be supplied in various profile configurations, and the components may be supplied in a variety of lengths. Of course, a ten foot long molding 10 would be required for a ten foot long worktop, etc.

The components may then be removably attached together with any removable attachment means known to the art. The removability of attachment means allows easy installation, repair, and replacement of molding 10. An exemplary attachment means is a centric sphere connector, described in detail below, and supplied by Häfele America Co., of Archdale, N.C. Other such removable attachment means known in the art include nuts and bolts, screws, and the like.

Figure 5:
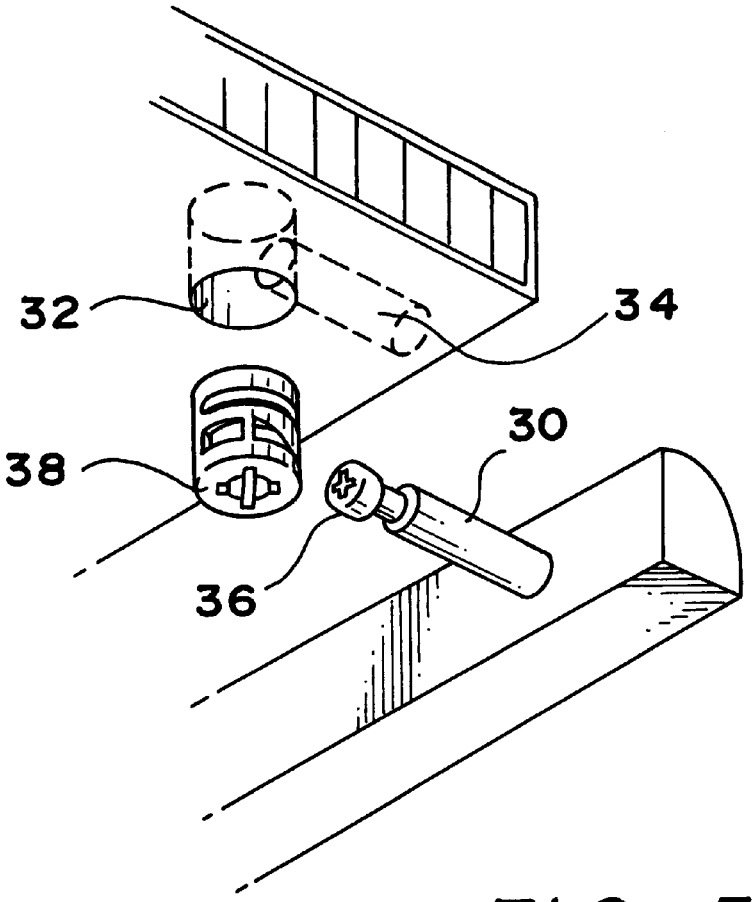
FIG. 5 is a partial perspective view of the underside of a worktop and front edge molding in accordance with the present invention.
Figure 6:
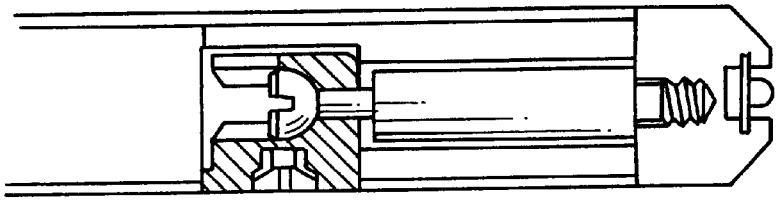
FIG. 6 is an elevational sectional view of an exemplary means for attaching a worktop surface member to a front edge in accordance with the present invention.
Figure 7A:
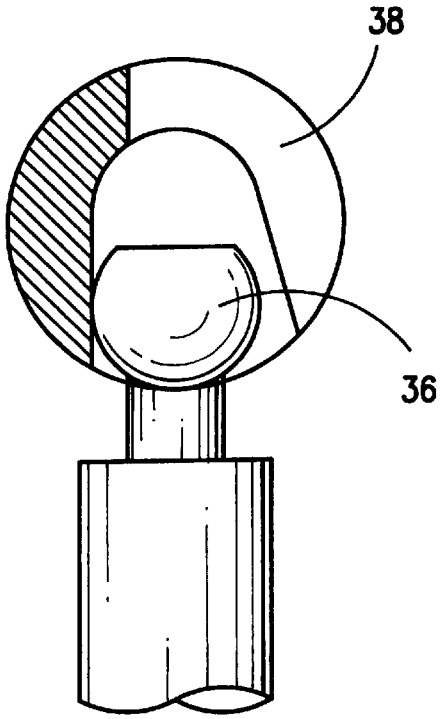
FIG. 7A is an exploded view of the exemplary means for attachment shown in FIG. 6 in the unlocked position.
Figure 7B:
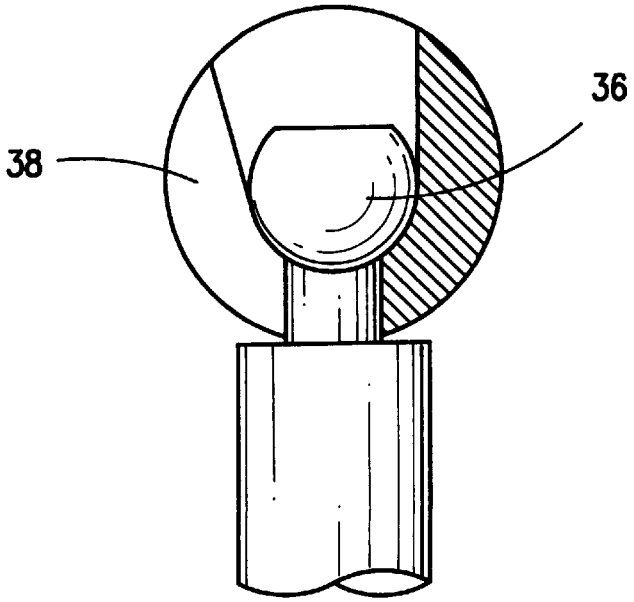
FIG. 7B is an exploded view of the exemplary means for attachment shown in FIG. 6 in the locked position.

Typical use of centric sphere connectors in the present invention would include fixing pins 30 into at least front edge molding 10 as shown in FIGS. 3 through 6, and providing vertical cavities 32 and horizontal cavities 34 in surface member 28. The locations of pins 30 and cavities 32 and 34, and the size of cavities 32 and 34, must be accurate per the hardware supplier's instructions to insure proper and secure attachment of the components. Referring now to FIGS. 5 and 6, pins 30 are inserted into cavities 34 such that their heads 36 are approximately centrally located within cavities 32. This allows insertion of locking cams 38 into cavities 32 over heads 36. Referring to FIG. 7A, locking cam 38 is provided with a vertical opening that allows it to slide over and encompass head 36. Cam 38 is also provided with a horizontal opening around a portion of its circumference. Referring to FIG. 7B, this horizontal opening allows cam 38, when rotated to the lock position, to grab onto pin 30 and put it into a state of tension. This causes front edge molding 10 to be tightly secured to surface member 28. The positioning of pins 30 and cavities 32 and 34 along the length of the components must be precise and frequent enough to insure accurate and quality assembly of the components.

Figure 8:
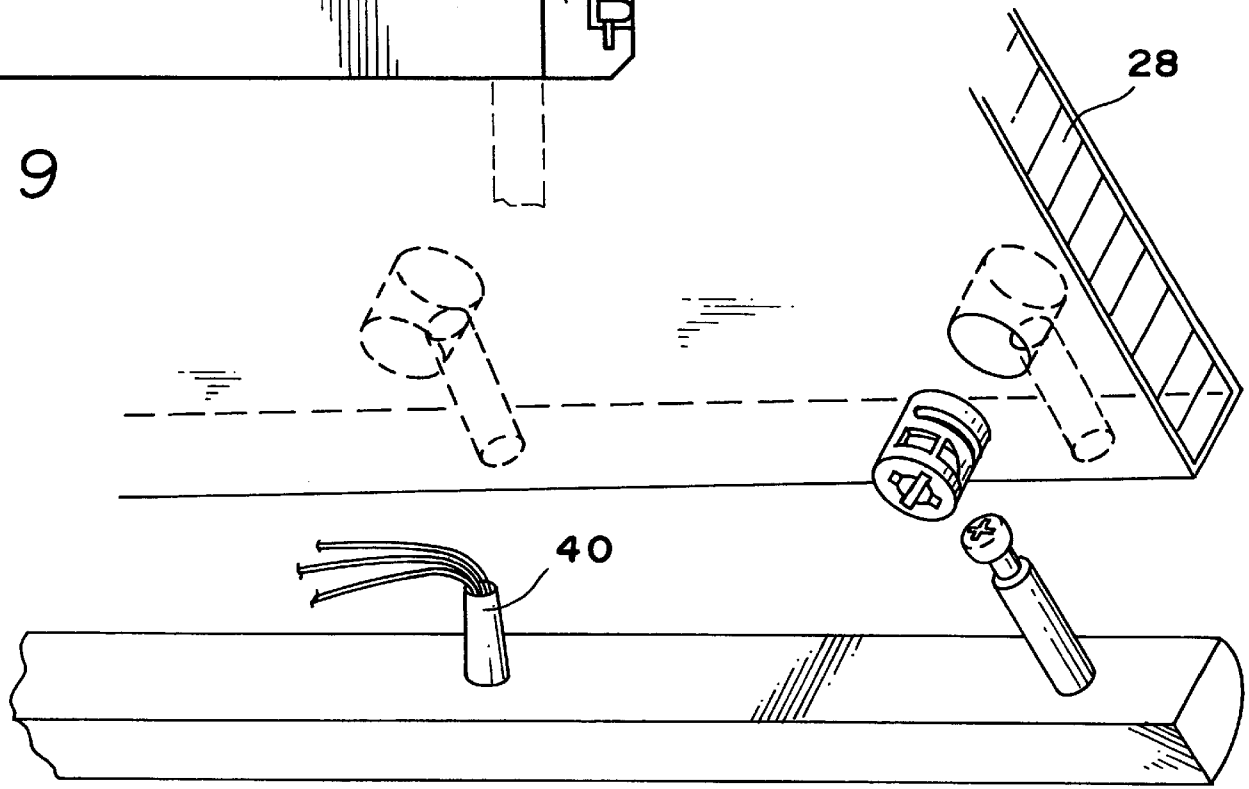
FIG. 8 is a partial perspective view of the underside of a worktop and front edge molding in accordance with the present invention, showing means for attaching a power supply to the molding.

Referring now to FIG. 8, one set of cavities 32 and 34 along the length of molding 10 and surface member 28 may be provided as a channel through which electrical connection 40 may be fed for coupling to a power source.

Figure 9:
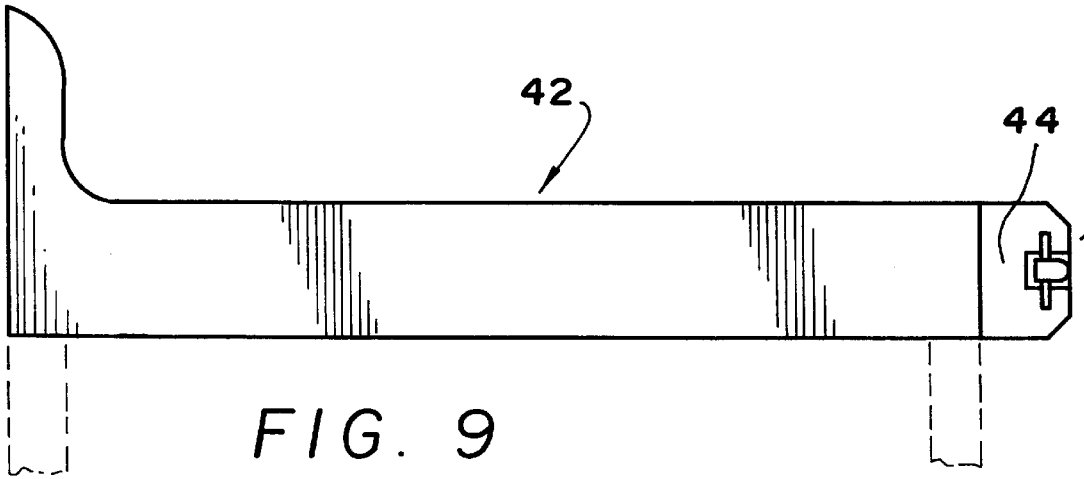
FIG. 9 is an elevational side view of a worktop and molding in accordance with the present invention, showing a finished end.

FIG. 9 shows finished end 42 of a worktop including molding 10. End 42 is typically covered with a piece of HPDL, or other decorative surfacing material, cut to fit the shape of end 42. Because backsplash 26 would generally not be readily removable, the piece of HPDL covering end 42 may include integral coverage for backsplash 26 and surface member 28. Front edge molding end 44, however, would need to be covered with a separate piece of HPDL, or other material, so as to facilitate any subsequent removal of molding 10. Because front edge molding 10 is removably attached to surface member 28, front edge molding 10 may be easily installed, repaired, or replaced as necessary.

Additional advantages and modifications will be readily apparent to one skilled in the art, while falling within the spirit and scope of the claimed invention. The claimed invention in its broader aspects is not, therefore, limited to the specific examples and structures described above and claimed below. Any such advantages and modifications, while not specifically described herein, are deemed to be within the spirit and scope of the presently disclosed and claimed invention.

What is claimed is:

1. A worktop, comprising:

a surface member; and a molding attached to the surface member, wherein the molding includes a body having an illuminating member inserted therein for viewing and at least one coupling member associated with the body, the coupling member being shaped and dimensioned for securely attaching the molding to the surface member.

2. The worktop according to claim 1, wherein the illuminating member comprises a repeating message board.

3. The worktop according to claim 2, wherein the molding is a front edge of the worktop, the molding being removably attached to the worktop.

4. The worktop according to claim 2, wherein the illuminating member comprises light emitting diodes.

5. The worktop according to claim 4, wherein the molding is a front edge of the worktop, the molding being removably attached to the worktop.

6. The worktop according to claim 1, wherein the illuminating member comprises a compound that glows under ultraviolet light.

7. The worktop according to claim 6, wherein the molding is a front edge of the worktop, the molding being removably attached to the worktop.

8. The worktop according to claim 7, wherein the coupling member includes a centric sphere connector removably attaching the molding to a support surface.

9. The worktop according to claim 1, wherein the illuminating member comprises a compound that glows in the dark.

10. The worktop according to claim 9, wherein the molding is a front edge of the worktop, the molding being removably attached to the worktop.

11. The worktop according to claim 10, wherein the coupling member includes a centric sphere connector removably attaching the molding to a support surface.

12. The worktop according to claim 1, wherein the illuminating member is energized by an alternating current power source.

13. The worktop according to claim 12, wherein the molding is a front edge of the worktop, the molding being removably attached to the worktop.

14. The worktop according to claim 13, wherein the coupling member includes a centric sphere connector removably attaching the molding to a support surface.

15. The worktop according to claim 1, wherein the illuminating member is energized by a direct current power source.

16. The worktop according to claim 15, wherein the molding is a front edge of the worktop, the molding being removably attached to the worktop.

17. The worktop according to claim 16, wherein the coupling member includes a centric sphere connector removably attaching the molding to a support surface.

18. The worktop according to claim 1, wherein the molding is a front edge of the worktop, the molding being removably attached to the worktop.

19. The worktop according to claim 18, wherein the coupling member includes a centric sphere connector removably attaching the molding to a support surface.

20. The worktop according to claim 1, wherein the coupling member includes a centric sphere connector removably attaching the molding to a support surface.

* * * * *